US006631905B1

(12) United States Patent
Slade

(10) Patent No.: US 6,631,905 B1
(45) Date of Patent: Oct. 14, 2003

(54) GAME APPARATUS AND METHOD FOR TEACHING BASKETBALL SKILLS

(76) Inventor: Sandy Slade, 2390 Steven Dr., Corona, CA (US) 92879

( * ) Notice: Subject to any disclaimer, the term of this patent is extended or adjusted under 35 U.S.C. 154(b) by 0 days.

(21) Appl. No.: 10/123,982

(22) Filed: Apr. 16, 2002

(51) Int. Cl.[7] ..... A63F 3/00
(52) U.S. Cl. ..... 273/244; 273/259; 273/277
(58) Field of Search ..... 273/236, 243, 273/244, 244.1, 244.2, 248, 249, 259, 277

(56) References Cited

U.S. PATENT DOCUMENTS

| | | | | | |
|---|---|---|---|---|---|
| 1,115,893 | A | | 11/1914 | Briare | |
| 3,722,885 | A | | 3/1973 | Leaf | |
| 4,059,275 | A | * | 11/1977 | Price | 273/240 |
| 4,121,823 | A | | 10/1978 | McBride | |
| 4,932,667 | A | * | 6/1990 | Gorski et al. | 273/249 |
| 5,123,653 | A | | 6/1992 | Murphy et al. | |
| 5,439,228 | A | * | 8/1995 | Pedersen | 273/236 |
| 5,544,891 | A | | 8/1996 | Gibson et al. | |
| 6,095,522 | A | * | 8/2000 | Spell et al. | 273/246 |
| 6,142,473 | A | | 11/2000 | Bryant | |
| 6,209,872 | B1 | | 4/2001 | Caswell | |
| 6,213,781 | B1 | | 4/2001 | Kimball | |

* cited by examiner

*Primary Examiner*—Benjamin H. Layno
*Assistant Examiner*—Vishu K Mendiratta
(74) *Attorney, Agent, or Firm*—Donn K. Harms

(57) ABSTRACT

A basketball skill teaching game apparatus and method for one or a plurality of players playing in a determined order. The apparatus features a game mat placed upon a playing surface and having a plurality of individual game squares arranged sequentially thereon. Upon a signal, from a starting point, the players commence play in a determined order and designated direction of play. Each player moves a determined number of squares from a starting point to a landing point which is another of the game squares, each of which has indicia thereon designating a specific physical exercise to be performed should a player land upon that square. Each of said players landing on their landing point during their respective turn reads the indicia thereon and communicates to fellow team members the specific physical exercise to be performed. When the team is done performing the exercise, the next player takes their turn and repeats the actions of the earlier player. The game is over when a signal is given and the team who has advanced the most squares wins.

20 Claims, 2 Drawing Sheets

GAME APPARATUS AND METHOD FOR TEACHING BASKETBALL SKILLS

FIELD OF THE INVENTION

This invention relates to the field of court and ball games. More particularly it relates to the game of basketball and a game method and apparatus for improving the skills of basketball players by performing various exercises and practice moves in the context of a game to improve-basketball proficiency.

BACKGROUND OF THE INVENTION

Basketball is a truly American sport having originated in the Midwest area of the United States. However, the time has long passed when the game was played by players using a peach basket and ball and minimal movement other than dribbling and shooting.

Basketball is one of the most widely played sports in the United States because of the small area needed for a court and because it may be played outdoors during good weather or indoors during any weather. The game is a major source of exercise and teamwork training for children and adults and is especially popular in areas where winter makes outdoor sports impractical.

Because of its popularity, especially amongst children and young adults capable of keeping the fast pace of the game for long durations, there is a constant need for the improvement of the skills of the players. This is especially true of young children who lack the requisite dribbling, passing, and shooting skills to play the game.

However, many teachers and coaches, especially dealing with younger players, lack sufficient knowledge of the game to teach or coach new or inexperienced players. Further, even teachers and coaches who have sufficient knowledge of Basketball rules and theory frequently lack a method and apparatus to provide organized and fun manner in which to teach new and inexperienced players the game.

Another problem when dealing with younger players it their inability to maintain the attention necessary to learn the basic and advanced skills during practice sessions. Attempting to teach younger players, one at a time, or in groups, the various skills of Basketball if frequently boring for the players who must watch as the Coach or teacher works with one player while the others wait in line for their turn to practice. When dealing with multiple children or larger groups of children, either more coaches are required so that many groups can stand in many lines to learn an individual skill or the large group must wait their turn to practice the skill of the moment with the coach while the others wait in line for their turn. With the severe lack of coaches and teachers able to afford the time necessary after and during school to teaching athletics, frequently there is only one coach to teach many children basic and advanced basketball skills which results in students using most of their time waiting in groups or lines and watching other students practice. This results in minimal practice for all of the players and increased boredom and disinterest by the players who must wait for their turn at being coached.

Consequently, there is a need for a method and playing apparatus to teach many skills to many players concurrently with a minimum of coaches. Such a method should make the maximum of the time allotted for practice by engaging all of the players constantly in basketball skill practicing.

Very little prior art exists in the area of the orderly and effective teaching of the skills and rules of basketball. U.S. Pat. No. 6,213,781 (Kimball) discloses a game for the teaching of the concept of speed and velocity. However Kimball is geared more toward science concepts and while it might teach a bit about baseball it lacks any instruction in the area of basketball.

U.S. Pat. No. 1,115,893, (Briare) is a board game that uses a board and dial and game pieces to play a version of basketball on the board. While Briare may help with the concept and rules of the game from a mental perspective, Briare does not offer any aid or instruction with the actual act of playing a real game of basketball where dribbling and shooting and passing the ball is required.

U.S. Pat. No. 5,123,653 (Murphy) teaches a basketball board game and apparatus. The board game uses cards, dice, a ball, and a small basket to allow players to "play" a game of basketball while sitting around a game table. However, Murphy also lacks any actual playing of a real game of basketball and any method to teach the actual physical skills involved in the game.

U.S. Pat No. 6,142,473 (Bryant) teaches a board game using a plurality of transparent sheets mounted along the periphery of the board. The sheets have an opening on one side and using dice and trading cards, and the sheets, the players play a pretend game relating to basketball. As in the other prior art, Bryant lacks any method or apparatus to teach actual physical skills to play a real game of basketball on a basketball court.

There is as such, a present and continuing need, for a method and apparatus for the teaching of basketball the new as well as experienced players. Such a method should provide for the teaching of the maximum number of players simultaneously with the minimum number of coaches. Such a game or method should also provide the players with sufficient interest in the outcome to maintain their interest in each individual step of the game to thereby maximize their learning of the different skills at each step. Such a game and method should also feature actual physical practice of the skills of basketball to thereby teach the players the various skills necessary to play the game. Finally, such a game and method should be easily played with simple rules to allow younger children to play the game and enjoy it while actually learning the basic and advanced motor skills involved in the playing of basketball.

SUMMARY OF THE INVENTION

The present invention accomplishes its desired objects by providing a versatile new and improved game and apparatus for the orderly teaching of basketball motor skills and rules to the players. The game and method teaches basketball skills in a fun way that is unique and challenging to the players. However the emphasis of the game is placed on participation and as a motivational supplement to conventional basketball practice, rather than on winning. It is used for the orderly teaching and reinforcing of different motor skills required in the play of basketball and allows the concurrent orderly teaching of a large number of players or students using minimal coaches. While more coaches can be provided during playing of the game, using the game mat and other parts, the players themselves keep occupied in learning various skills concurrently thereby maximizing the learning of motor skills with minimal supervision.

In the best embodiment of the disclosed game and method a game mat is used with various spots designated on the mat where the practice of different motor skills is performed during the players turn at that spot. Also provided are a plurality of colored basketball shaped bean bags, a plurality of cones, a plurality of colored dice and a plurality of miniature baseball shaped chips.

In the current preferred mode, there would six of the basketball or other novel shaped bean bags of different colors, six of the colored dice in the same respective colors as the bean bags, forty of the basketball chips, and one game mat sized approximately five feet by seven feet in the current best embodiment. Also provided are plastic laminated or similarly protected game cards sized in the current best mode of the device approximately 8½ inches by 11 inches.

To play the game with six teams, the game mat would be unrolled onto the area for play and the class of students would be divided into six equal teams. Basketball beanbags and colored dice of the same color from the six different colors, would be placed on a spot on the mat that is also of the same color. Around the game mat in the playing area cones are placed in six different positions to designate a team's home court.

Each of the six teams would have a designated home court and each of the teams would be provided with a game card which identifies that team's home court designated by the cone. Each player is also provided with one or a plurality of basketballs they can use during playing of the game.

The teams having been assigned their color from the six colors and their home court can then begin to play. Each team is assigned a number by the teacher or by a rolling of the die by each team until all have different numbers from one to six. Then, each team member of each team is assigned a number, usually from one to six, either by lot, teacher assignment, or rolling the die.

Play begins with the announcement by the coach or teacher or other leader that the game has started or optionally by playing of music.

The playing mat has a plurality of squares drawn, printed, or otherwise placed thereon in a row around the perimeter of the game mat. An arrow is also printed on the mat to show a direction of play.

Player number one of each team rolls their colored die to arrive at a number and then moves that team's colored basketball piece and the colored die, to a square on the playing mat corresponding to the number rolled and in the designated direction of play. The colored basketball piece and the die is placed in the square by that player for the next player to roll.

Once they have arrived at the determined square on the playing mat, the player who rolled the die reads the instructions printed in that square on the playing mat, returns to his or her team's home court, and explains it to the rest of the team.

Optionally, if provided as would be in the current best mode, the same instructions are printed on a miniature version of the game mat which is on the laminated card. Everyone on the team performs the drill or exercise designated in the square they have drawn on the game mat.

Once everyone has completed the designated exercise from the square on the game mat, the next player on each team, in numerical order, walks to the square on the game mat where the colored die and basketball bean bag is located, and rolls the die. That player then moves the bean bag and die to the next square on the game mat which corresponds to the number just rolled by counting the squares in the direction of play until they reach the square corresponding to the number rolled. The player sets the team bean bag in the square and the colored die and reads the instructions printed in the square. The player then goes back to the team home court and relays the instructions to the waiting team members as to the exercise designated in that square. This sequence is repeated for the duration of the time allotted for the game which would generally be the class period or the time allotted for practice.

Once a team goes around the entire game mat and past the starting point, they are awarded a point which is designated by a basketball chip in their team designated color or some other means to keep score of the points obtained by the team. The players continue to roll the die in sequence and continue to move the beanbag and die to new squares corresponding to the number rolled and in the direction of play around the mat for the duration of the game. The team with the most points, signified by colored basketball chips or other means of keeping the point score, at the end of the game, is the team who has gone around the board past the starting point the most times during the time for play. That team wins the game.

If the game is not intended for competition, the awarding of the points signified by colored chips or other score keeping means when circumvention of the board is completed can be eliminated. In that manner the game can just be played in sequence for the duration of playing time.

The skills that are designated in each square on the game mat would be skills that the players would need to play the game of basketball. Dribbling, passing, catching, and other skills would be included and the game mat might be produced in various forms with age and skill appropriate tasks printed in the squares about the perimeter of the game mat. Very young children might just land on squares that designate dribbling or catching and older players could have more advanced skills such as bounce passing.

As can be seen, once the game begins, there is minimal supervision and teaching required by the coach who can either just observe, or observe and go to different players and teams to help with their learning and practice of a designated skill.

A primary object of this invention is to provide a game that will teach the skills involved in the play of basketball in an organized and fun fashion to groups of players.

A further object of this invention is the provision of an easily played game that requires minimal supervision by a coach or teacher yet results in all of the players concurrently receiving maximum practice time of various exercise and skills.

Another object of the invention is to provide. a method and apparatus to teachers and coaches for the organized teaching of basketball skills.

An additional object of this invention is to provide a fun and entertaining method of practicing basketball that maintains the players interest during the entire time period of play.

These together with other objects and advantages which will become subsequently apparent and reside in the details of the construction and operation as more fully hereinafter described and claimed, reference being had to the accompanying drawings forming a part hereof, wherein like numerals refer to like parts throughout.

BRIEF DESCRIPTION OF THE DRAWING FIGURES

The accompanying drawings, which are incorporated in and form a part of this specification, illustrate embodiments of the invention and together with the description, serve to explain the principles of the invention.

DETAILED DESCRIPTION OF THE PREFERRED EMBODIMENTS

Figure 1:
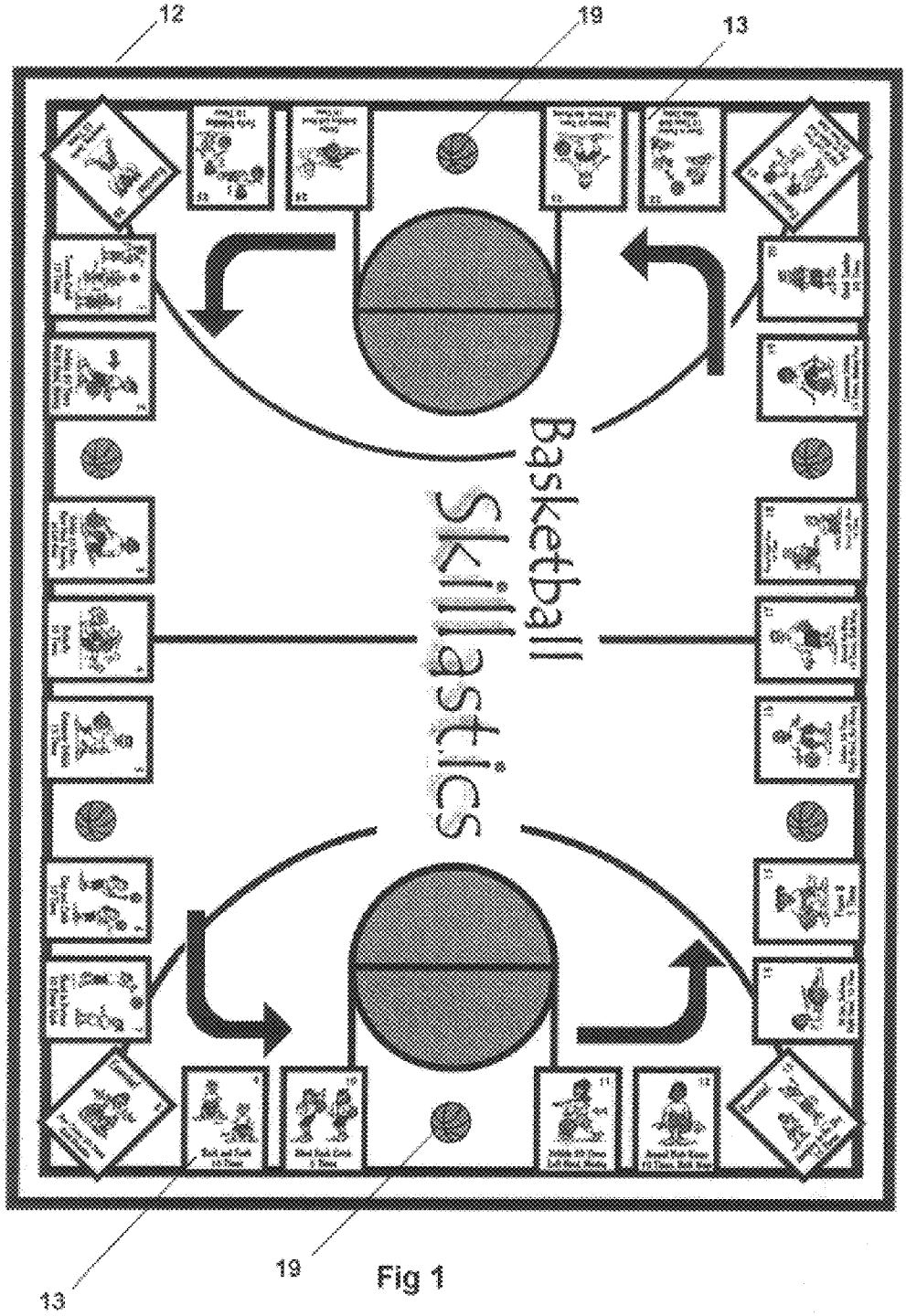
FIG. 1 depicts a top plan view of a game mat as would be used with the game and method herein disclosed and described.
Figure 2:
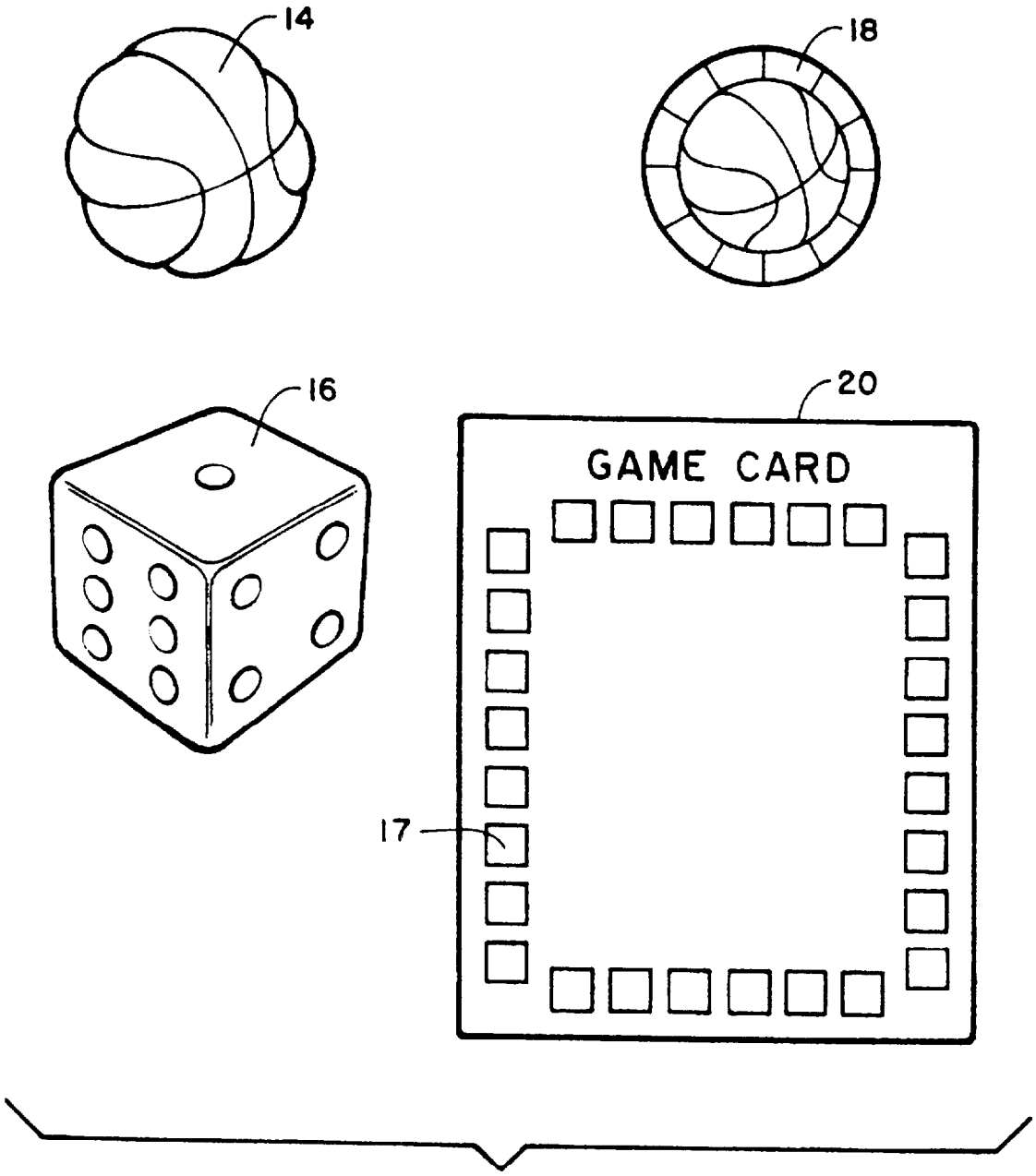
FIG. 2 depicts the game pieces used for play.

Referring now to drawing FIG. 1 showing the game mat 12 used for the orderly play of the herein disclosed method and apparatus for practicing basketball. While shown as a game mat 12, the plurality of game positions for players to land upon are provided by game squares 13 could also be provided as small mats which would be placed in the area of play in a square or circular pattern and similar orders of play designated. The game mat 12 in the current best embodiment works best and avoids the accidental loss or misplacement of one of the game squares 13 and also provides other attributes.

As noted earlier, in a current preferred embodiment of the game, provisions would be made for six different teams since a conventional die has six sides. However there could be more or less teams depending on the number of players and space involved and the time available to play the game and the die could be adjusted to have more sides if desirable. In a competitive embodiment of the game there would have to be a plurality of teams who would play for speed and to beat each other however it is envisioned that for small gathering only one team could play the game, or multiple teams could play the game simply for organized and fun practice of basketball skills.

Assuming a plurality of teams playing the game, there would provided a means to designate team position on the game board in the form of bean bags 14 currently shaped like a basketball, in a plurality of different colors sufficient to accommodate the number of different teams intended to play the game. Colorizing the bean bags and other game parts provides a means to designate the team assigned to those game parts. Also provided would be a plurality of colored die 16 of the same colors as the bean bags 14. For use in the competition embodiment of the game, a means to tally points would be provided such as pen and pencil, or in the current best mode of the device, a plurality of basketball shaped chips 18. Those skilled in the art will of course realize that other means to keep score of the points designating the number of complete circumventions of the game mat 12 could be provided and such is anticipated. Also provided as an option for f ease of use for one or plurality of teams playing the game are game cards 20 with the exercises designated on the game squares 13 of the game mat 12 shown on the game card 20 in smaller squares 17. In the current best mode, the game cards 20 would be miniature versions depicting the graphics and indicia of the game mat 12.

To play the game, the game mat 12 would be unrolled onto the area for play and the players would be divided one or a plurality of teams. In the case of a plurality of teams, the number in each team should be substantially equal especially when competition is intended to thereby insure fair play.

The bean bags 14 or similar means to designate team position on the game mat 12, and the die 16, both of the same color from the plurality of colors, would be placed on a designated starting position 19 on the game mat 12. In cases where the game squares 13 are individual pieces which are laid on the ground or other flat surface to form the game mat 12, the starting position 19 could also be an individual piece laid upon the ground or playing surface. In the current best mode, a plurality of different starting positions 19 would be designated on the game mat 12 in a plurality of different colors with the bean bag 14 and die 16 would be place on a starting position 19 of the same color to thereby designate the team attached to that color. Also in the current best mode, around the game mat 12 in the playing area, adjacent to the teams starting position 19, a team's home court or congregation position during the game would be formed and also best designated by the color of the team. The teams would congregate at their individual congregation position adjacent to the appropriate colored starting position during play of the game.

During play of the game, ideally, each player is provided with one or a plurality of basketballs (not shown) or similar balls which they use during playing of the game. The teams having been assigned their team designating color from the plurality of colors and having assembled at their congregation position adjacent to the starting position 19, can then begin to play. Each team is assigned a number or letter or some team designation to individually identify each team by the teacher or by a rolling of the die 16 or by lot, or other means to assign a different individual designation to each team such that each team as its own individual designation. In the current best mode each team would have different numbers in sequence. Then, each team member of each team is assigned their own number either by lot, teacher assignment, or rolling the die 16. Play begins with the announcement by the coach or teacher or other leader that the game has started or optionally by playing of music which can be used to liven the pace with fast music or to relax the pace of the game with slower music. A conventional means to play music such as a CD player (not shown) or tape player (not shown) would be used.

As shown, the playing mat 12 is formed of a plurality of game squares 13 drawn, printed, appliqued, or otherwise placed thereon in a row around the perimeter of the game mat 12. The playing mat 12 might also be formed of individual game squares 13 formed in individual pieces and laid upon the playing surface in the proper order to form the playing mat 12. A directional arrow 24 is preferably printed on the playing mat 12 to provide a means to indicate the direction of play however any suitable means to designate the direction of play could be used.

The player with the lowest number assigned to that player, from each team, then rolls their team's colored die 16 to determine a number and then moves that team's bean bag 14 or other position designator along with the colored die 16, to a game square 13 on the playing mat 12 or playing surface if individual game squares are used, corresponding to the number rolled, from the teams starting point 19 and in the designated direction of play. The teams's bean bag 14 and the die 16 is placed in the game square 13 by that player and left there for the next player to return to roll.

Once the player playing for his or her team, has arrived at the determined game square 13 on the playing mat 12, the player who rolled the die 16 reads the instructions printed in that game square 13 on the playing mat 12, returns to the team's starting point 19, and explains it to the rest of the team which is assembled adjacent to the team's starting point 19. Optionally, if provided, the same instructions and indicia from the determined game square 13 are printed on a miniature version of the game mat which is on the game card 20. Everyone on the team performs the drill or exercise designated in the game square 13 their player has arrived upon on the game mat 12.

Once everyone on the team has completed the designated exercise from the game square 13 landed upon on the game mat 12, the next player on each team who had the next number in order when assigned or drawn, walks to the game square 13 on the game mat 12 where the team's colored die 16 and bean bag 14 is located, and rolls the die 16. That player then moves the bean bag 14 and die 16 to the next game square 13 on the game mat 12 or playing surface in the case of individual game squares 13 which corresponds to the number just rolled, by counting the game squares 13 in the direction of play until they reach the game square 13 corresponding to the number rolled. The player sets the team's bean bag 14 in the game square 13 along with the colored die 16 and reads the instructions printed in that new game square 13. The player then goes back their team assembled adjacent to their team's starting point 19 and relays the instructions to the waiting team members as to the exercise designated in that new game square 13. This sequence is repeated for the duration of the time allotted for the duration of the game which would generally be the class period or the time allotted for practice.

Once a team goes around the entire game mat and past their team's starting point 19, they are awarded a point which would be designated by the basketball shaped chip 18 or similar means to designate a full circumvention of the game mat 12 preferably in their team's designated color. The players continue to roll the die 16 in sequence and continue to move the beanbag 14 and die 16 to new game squares 13 corresponding to the number rolled and in the direction of play for the duration of the game. The team with the most points determined by the number of basketball shaped chips 18 or similar means to keep score of complete circumventions around the game mat 12 when time is up, is the team who has gone around the game board 12 past their starting point 19 the most times during the time for play. That team wins the game.

If the game is not intended for competition, the awarding of the points and the use of basketball shaped chips 18 to designate when circumvention of the board is completed can be eliminated and the game can just be played in sequence for the duration of playing time. This embodiment may be more suitable for younger children.

The skills that are designated in each square on the game mat would be physical skills and exercises which the players would generally need to play the game of basketball. There may be the same skill designated in more than one of the game squares 13. As noted earlier, dribbling, passing, catching, stretching, and other exercises and skills would be included in the different game squares 13 and the game mat 12 or the individual game squares 13 might be produced in various forms with age and skill appropriate tasks printed in the squares about the perimeter of the game mat 12. The game squares 13 might also be arranged in a circle or in a serpentine manner or some other arrangement so long as there is a visual means to designate the direction of play designation provided to tell the players which way to go when the die 13 is rolled.

While all of the fundamental characteristics and features of the present invention as a device and method have been described herein, with reference to particular embodiments thereof, a latitude of modification, various changes and substitutions are intended in the foregoing disclosure and it will be apparent that in some instance, some features of the invention will be employed without a corresponding use of other features without departing from the scope of the invention as set forth. It should be understood that such substitutions, modifications, and variations may be made by those skilled in the art without departing from the spirit or scope of the invention. Consequently, all such modifications and variations are included within the scope of the invention as defined by the following claims.

What is claimed is:

1. A basketball skill game apparatus for one or a plurality of players playing in a determined order, comprising: at least one baskeball a game mat, said game mat sized to allow said players to walk about its perimeter when said game mat is placed upon a playing surface;

said game mat having a plurality of individual game squares arranged sequentially;

said game mat having at least one starting point thereon said starting point determining the point at which a team of said one or plurality of players commences play of said basketball skill game;

said game mat having a designated direction of play when moving from said starting point and between said individual game squares;

means to signal the start of said basketball skill game;

each of said individual game squares having indicia thereon, said indicia sized to be read by players from a standing position adjacent to said individual game square, said indicia designating a specific physical exercise to be performed with a basketball should a player land upon said individual game square during play of said basketball skill game;

means to determine a specific number of said individual squares a player will advance during a turn at play whereby each of said players on each respective team may sequentially take their respective turns at play and move a determined number of squares upon said game mat by walking around said game mat during their respective turn at play, thereby landing upon a specific landing point on one of said individual game squares; and whereby each of said players walking to said specific landing point during their respective turn, may read said indicia upon said landing point and communicate to fellow team members said specific physical exercise to be performed with said basketball, wherein all of said team members complete said specific physical exercise before the next said turn at play is initiated.

2. The basketball skill game apparatus of claim 1 further comprising:

means to mark the position of said players on said specific landing point during play.

3. The basketball skill game apparatus of claim 2 further comprising:

means to signal to players the game is ended.

4. The basketball skill game apparatus of claim 2 further comprising:

each team having at least one game card, said game card being a miniature rendition of said game mat.

5. The basketball skill game apparatus of claim 2 further comprising:

means to keep track of the number of times a player passes said staring point during play of the game.

6. The basketball skill game apparatus of claim 5 further comprising:

each team having at least one game card, said game card being a miniature rendition of said game mat.

7. The basketball skill game apparatus of claim 6 wherein said means to determine a specific number of said individual squares a player will advance during a turn at play is a die.

8. The basketball skill game apparatus of claim 1 further comprising:

means to keep track of the number of times a team passes said staring point during play of the game.

9. The basketball skill game apparatus of claim 8 further comprising:

means to signal to players the game is ended.

10. The basketball skill game apparatus of claim 8 further comprising:

each team having at least one game card, said game card being a miniature rendition of said game mat.

11. The basketball skill game apparatus of claim 1 further comprising:

means to signal to players the game is ended.

12. The basketball skill game apparatus of claim 11 further comprising:

each team having at least one game card, said game card being a miniature rendition of said game mat.

13. The basketball skill game apparatus of claim 11 wherein said means to signal the start of said basketball skill game is the playing of music and said means to signal to players the game is ended is the cessation of the playing of said music.

14. The basketball skill game apparatus of claim 1 further comprising:

each team having at least one game card, said game card being a miniature rendition of said game mat.

15. The basketball skill game apparatus of claim 1 wherein said means to signal the start of said basketball skill game is the playing of music.

16. The basketball skill game apparatus of claim 1 wherein said means to determine a specific number of said individual squares a player will advance during a turn at play is a die.

17. A method for teaching and practicing basketball skills using a game mat having at least one starting point and also having a plurality of individual game squares arranged sequentially in a designated direction of play, which is placed upon a playing surface, with each of said individual game squares having indicia thereon designating a specific physical exercise for a player to perform should said player land upon said individual game square during play of said basketball skill game, and using a means to determine a specific number of said individual squares to advance during a turn at play, comprising the steps of:

(a) choosing individual teams formed of one or a plurality of team members;

(b) choosing a playing order for said team members of each of said individual teams with one of said team members playing first on behalf of said team;

(c) issuing a signal understood by all of said team members to begin play;

(d) the first player in said playing order for each of said individual teams using said means to determine a specific number of said individual squares to advance to determine a number of squares to advance during the first player's turn;

(e) moving forward from said starting point said number of squares to advance to an individual game square;

(f) said first player reading the indicia on said individual game square and communicating to the other players on the first player's team said specific physical exercise determined by said indicia on said individual game square;

(g) each team member performing said designated specific physical exercise;

(h) upon completion by the team of said specific physical exercise, a next team member in said playing order for each of said teams respectively, using said means to determine a specific number of said individual squares to advance to thereby determine a number of squares to advance during said next player's turn;

(i) the next team member advancing said specific number of squares to advance during said next player's turn thereby landing on another of said individual squares;

(j) said next team member reading the indicia on said another of said individual squares and communicating to the other players on the next player's team said specific physical exercise determined by said indicia on said another of said individual game squares;

(k) each team member performing said designated specific physical exercise communicated by said next team member; and (l) each player of each of said teams continuing this sequence in said playing order until a signal is communicated to the players that the game is ended.

18. The method for teaching and practicing basketball skills of claim 17 wherein music is played to signal commencement of said game and said music is stopped to signal the end of said game.

19. The method for teaching and practicing basketball skills of claim 17 comprising the additional steps of:

(m) each respective team totaling total number of squares which each respective team has advanced during play of said game; and (n) the team with the highest total of squares advanced during play being declared the winner.

20. The method for teaching and practicing basketball skills of claim 19 wherein music is played to signal commencement of said game and said music is stopped to signal the end of said game.

* * * * *